US006557468B2

(12) United States Patent
Kelm et al.

(10) Patent No.: US 6,557,468 B2
(45) Date of Patent: May 6, 2003

(54) DELIVERY FOR A SHEET PROCESSING MACHINE, PARTICULARLY FOR A SHEET-FED PRINTING MACHINE

(75) Inventors: Carsten Kelm, Ketsch (DE); Richard Mack, Kennesaw, GA (US); Klaus Thome, St. Leon-Rot (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/925,165

(22) Filed: Aug. 8, 2001

(65) Prior Publication Data

US 2002/0043758 A1 Apr. 18, 2002

(30) Foreign Application Priority Data

Aug. 8, 2000 (DE) ..... 100 38 502

(51) Int. Cl.[7] ..... B65H 29/24

(52) U.S. Cl. ..... 101/242; 101/239; 101/241; 271/183

(58) Field of Search ..... 101/240, 241, 101/242, 232, 233, 239; 271/182, 183, 187, 195

(56) References Cited

U.S. PATENT DOCUMENTS

| | | | | |
|---|---|---|---|---|
| 4,225,129 A | * | 9/1980 | Zimmermann et al. | 271/183 |
| 4,479,645 A | | 10/1984 | Pollich | |
| 5,221,079 A | * | 6/1993 | Most et al. | 271/202 |
| 5,263,415 A | * | 11/1993 | Pollich | 101/232 |
| 5,287,158 A | * | 2/1994 | Nagashima et al. | 209/552 |
| 5,358,236 A | | 10/1994 | Maass et al. | |
| 5,446,524 A | * | 8/1995 | Koike | 271/9.05 |
| 6,407,829 B1 | * | 6/2002 | Nakamura | 250/559.4 |

FOREIGN PATENT DOCUMENTS

| | | |
|---|---|---|
| DE | 24 46 549 | 4/1975 |
| DE | 31 13 750 A1 | 10/1982 |
| DE | 42 11 922 A1 | 10/1993 |
| DE | 40 35 035 C2 | 5/1996 |
| DE | 197 09 083 C1 | 10/1998 |
| GB | 1 481 466 | 7/1977 |

* cited by examiner

*Primary Examiner*—Andrew H. Hirshfeld
*Assistant Examiner*—Dave A. Ghatt
(74) *Attorney, Agent, or Firm*—Laurence A. Greenberg; Werner H. Stemer; Ralph E. Locher

(57) ABSTRACT

The delivery for a sheet-processing machine, such as a sheet-fed rotary printing press, has several braking devices which are movable transverse to a sheet transport direction. The delivery also has a sheet guiding elements that respectively cover the interspaces between adjacent braking devices at a level of the top edges. The sheet guiding devices are formed from a flexible tape material. The length of the tape transverse to the direction of sheet transport and seen from above is adjustable to the spacing between the adjacent braking devices.

11 Claims, 6 Drawing Sheets

DELIVERY FOR A SHEET PROCESSING MACHINE, PARTICULARLY FOR A SHEET-FED PRINTING MACHINE

BACKGROUND OF THE INVENTION

Field of the Invention

The invention lies in the sheet processing field. More specifically, the invention relates to a delivery for a sheet-processing machine, particularly for a sheet-fed offset printing machine.

Reference is had to U.S. Pat. No. 4,479,645 (see German published patent application DE 31 13 750 A1), which provides an example of a sheet delivery.

Deliveries of the type described here are located at the end of a sheet processing apparatus, such as at a sheet-fed printing machine. They comprise revolving guide chains with gripper bridges which grasp the individual sheets and convey them to a stacking shaft. A delivery stack is formed therein. Various requirements related to careful handling of the paper and the printed image must be satisfied in the delivery process. Specifically, care must be taken that neither the printed image nor the sheets are damaged, which could be disadvantageous in post-processing.

In order to guarantee a gentle and controlled delivery, braking devices are provided, which are known as brake modules. These may be formed, for example, of a plurality of suction disks or suction tapes which are disposed on a horizontal shaft that extends transverse to the direction of sheet transport. By means of the braking modules, a suction force can be brought to bear on the sheets in order to decelerate them and prevent the sheets from hitting the appertaining stops of the stacking shaft with force.

The brake modules must be arranged such that, seen perpendicular to the direction of sheet transport, they only make contact with unprinted regions of a sheet which has been printed on both sides (perfecting), so that the printed image is not impaired.

Since the uninked regions extend in different locations of the sheet from one copy to the next, as seen perpendicular to the direction of sheet transport, the brake modules must be variably positionable in the perpendicular direction, accordingly.

Depending on the printed image, a variably large number of brake modules can be used. For some printed images, only three brake modules are used. In such a case, the sheet may slacken between two adjacent brake modules, causing the sheet with its printed image to rub against components of the machine, which leads to smearing of the printed image. This, of course, is unacceptable.

Such cases require that the sheet be supported in the regions between the brake modules. Guide straps may be considered as support elements. These also may be used only in unprinted regions, though these regions need not be as wide as with brake modules. Due to the givens in the delivery, the sheet cannot always be guided precisely orthogonally during the entire depositing process, and therefore the guide straps may also come in contact with printed regions and cause the ink to smear.

What are known as starwheels have also been used as support elements. These can be used in printed regions as well; however, they cause a certain marking of the printed image.

It has also become known to bridge the interspaces between the brake modules using sheet guide plates. The width of the sheet guide plates perpendicular to the direction of sheet transport is dimensioned such that they close off the interspace between two adjacent brake modules. It is thus possible to build an air cushion between the individual sheet guide plate and the bottom of the sheet, as a consequence of which the sheet can be transported without smearing. However, it is difficult and time-consuming to work with such guide plates. The guide plates can be attached only after the individual brake modules have been preset to the current subject. It is also necessary to tailor the guide plates to the respective distance between the brake modules. This requires a number of plates of varying widths from one job to the next. Adjusting the position of the brake modules during the press run is out of the question.

U.S. Pat. No. 5,358,236 (German published patent application DE 42 11 922 A1) describes a table cover device for a sheet-fed printing machine. The object of that type of device is to create a feed table cover in the region of the side lays for secure sheet guidance.

All the prior art guide mechanisms preclude a completely remote operation of the sheet brake. This is so because manual set-up procedures are always required in order to adjust the brake module to the current subject.

SUMMARY OF THE INVENTION

It is accordingly an object of the invention to provide a delivery for a sheet processing machine, particularly for a sheet-fed printing machine, which overcomes the above-mentioned disadvantages of the heretofore-known devices and methods of this general type and which allows the braking function to be executed perfectly. Thus, the actual braking function should be fulfilled as desired. Sagging of the sheet and thus smearing are prevented. Marking by support elements is also avoided. Lastly, the sheet brake is intended to be remote-controllable, so that manual set-up procedures are no longer needed for adjustment purposes. Remote operation and/or automation should be possible.

With the foregoing and other objects in view there is provided, in accordance with the invention, a delivery for a sheet processing machine wherein sheets are delivered in a sheet transport direction, comprising:

- a plurality of braking devices displaceably disposed transverse to the sheet transport direction and forming interspaces therebetween with a variable spacing; and
- sheet guiding elements respectively covering the interspaces between adjacent braking mechanisms, the sheet guiding elements including a tape of flexible material having a length, transverse to the sheet transport direction, as seen from above, adjustable to the spacing between the adjacent braking devices.

In accordance with an added feature of the invention, the sheet guiding elements comprise:

- a tape between each two adjacent braking devices and having a first end and a second end;
- a dispensing roller with a longitudinal axis parallel to the sheet transport direction allocated to one of two adjacent braking devices;
- the first end of the tape surrounds the dispensing roller and the second end of the tape is fastened to the respectively other braking device; and
- a winding drive allocated to the dispensing roller.

In accordance with an additional feature of the invention, the winding drive is a spring disposed to bias the dispensing roller to continuously keep the tape taut. In the alternative, or additionally, the winding drive is a motorized winding drive or a pneumatic winding drive.

In accordance with an alternative feature of the invention, the sheet guiding elements comprise:

a single tape for all the braking devices;

the single tape having two ends respectively fastened to lateral frames of the delivery;

the tape surrounding the individual the braking devices and wrapping around the braking device underneath.

In accordance with another feature of the invention, guide rolls are provided for guiding the tape.

In accordance with again a further feature of the invention, a respective tape is provided between each two adjacent braking devices; each end of the tape is fastened to one of the braking devices; and a dancer roller, which carries a memory loop of the tape, is disposed to compensate a length change of the tape given changes in the spacing between the brake devices.

As noted above, the delivery is particularly suitable for a sheet-fed printing machine. In that case, there is provided, in accordance with the invention, a data memory for storing data related to an image to be processed in the printing machine;

a computer for generating control signals correlated with unprinted corridors of the image;

and the braking devices are configured to be adjustable by actuating drives controlled by the control signals generated by the computer, into positions correlated with the unprinted corridors.

In accordance with again an added feature of the invention, an image reader configured to set and read into the data memory the data correlated with the image. The image reader may be a CCD camera. Where the printing machine transfers images via printing forms, the image reader may advantageously be a plate reader.

In accordance with again another feature of the invention, a plurality of dispensing rollers form sections of a flat structure.

In accordance with a concomitant feature of the invention, the tape is a flexible one-piece flat structure deflected about a plurality of guides defining segments of the flat structure.

The inventors have taken a new path. They have selected a tape of flexible material as the sheet support element. They have taken precautions to make the length of the tape, as seen perpendicular to the direction of sheet transport and from above, adjustable to the distance between the mutually spaced brake elements. Between the inventive tape-shaped sheet guide element and the bottom of the sheet, an air cushion can be formed, which supports the sheet and prevents it from sagging and thereby prevents smearing. The air cushion is continuously maintained, notwithstanding the adjustability of the brake modules.

Different variants are conceivable for realizing the inventive idea.

According to the first variant, as outlined above, a tape can be allocated to respective adjacent brake modules. One of the ends of the tape is fastened to one of the two brake modules, while the other end of the tape is wound onto a spool (roller) which is disposed at the other brake module, with its longitudinal axis extending in the direction of sheet transport. In this exemplifying embodiment, if two adjacent brake modules are repositioned relative to each other, i.e. if the spacing between them is expanded or reduced, the tape is wound from or onto the roller. The roller is provided with a winding drive. This can consist of a spring, as in a window shade mechanism. In this case, the tape automatically remains taut, regardless of the spacing between the two brake modules, so that the tape extends in a plane and does not develop any creases. This has a positive effect on the formation of the air cushion which forms between the tape and the bottom of the sheet. No further influencing of the functioning of the tape is required.

Alternatively, a motorized or pneumatic drive can be provided, which is controlled in dependence upon the positioning of the appertaining brake module.

According to a second variant, only a single tape is provided. The two ends of the tape are fastened to the lateral parts of the frame of the press. The tape wraps around the individual brake modules such that it surrounds the appertaining module underneath.

To guide the tape, guide rolls can be provided at all guide points, except when a roller is used. These naturally extend with their longitudinal axes in the direction of sheet transport as well.

The following solution is proposed as a third variant: A tape is provided between two adjacent brake modules, with one of its ends fastened to one module, and the other end fastened to the other module. A memory loop with dancer rolls is provided to compensate the length of the tape when the spacing between the modules changes.

It is understood that the tape must be situated at a height that is substantially within the region of the working plane of the brake modules. The gap which necessarily emerges (in a plan view) between the brake module and the tape should be optimally small. To this end, if a roller is used it is best to lead the tape by means of a guide roll to the relevant brake module which bears the former roller.

Any kind of rollable material may be used as the material for the tape, for instance a foil, a (dense) fabric, or a sheet which is extremely thin.

The inventive principle can be applied particularly effectively given straight printing and perfecting operations. In this method, the sheet is turned as it runs through the machine in order to enable printing on the other side.

The invention is not limited to using a specific brake module design. The individual brake module can substantially comprise a suction disk whose axis extends in a horizontal plane and transverse to the direction of sheet transport. But it is also possible to provide two rollers or drums, also with their respective axes arranged in a horizontal plane and transverse to the direction of sheet transport.

Other features which are considered as characteristic for the invention are set forth in the appended claims.

Although the invention is illustrated and described herein as embodied in a delivery for a sheet processing machine, particularly for a sheet-fed printing machine, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DETAILED OF THE PREFERRED EMBODIMENTS

Figure 1:
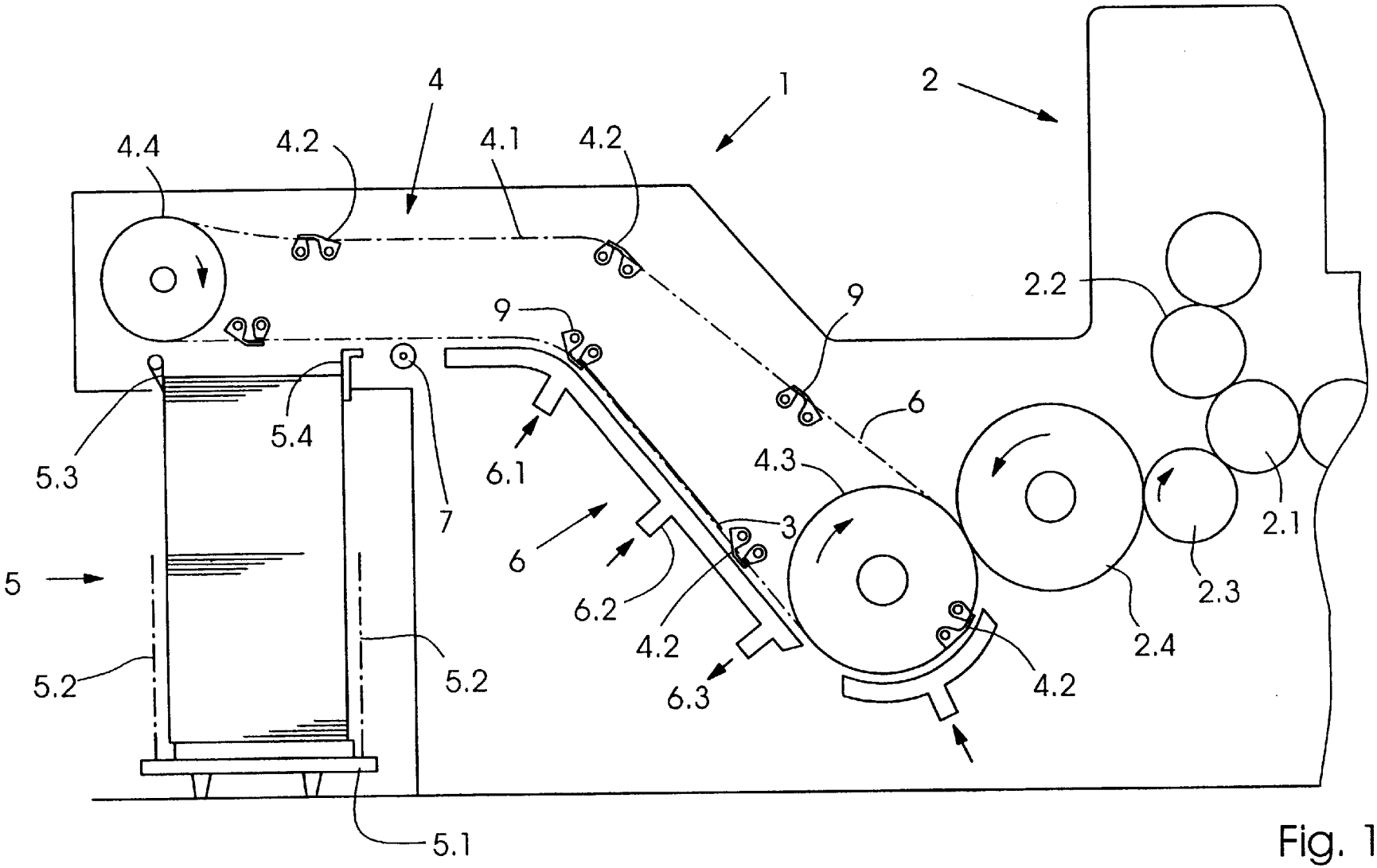
FIG. 1 is a side view of a sheet delivery.

Referring now to the figures of the drawing in detail and first, particularly, to FIG. 1 thereof, there is seen a delivery 1. The exemplary embodiment illustrated in FIG. 1 is a chain delivery. It is connected in series with a printing unit 2 of a printing machine. The printing unit comprises, in diagrammatic illustration, an impression cylinder 2.1, a rubber blanket cylinder 2.2, a single-diameter transfer drum 2.3, and a double-diameter transfer drum 2.4.

Individual sheets 3 are forwarded from the printing unit 2 to a stacking device 5 by way of a chain conveyor 4. The stacking device 5 has a platform 5.1 and roller chains 5.2, as well as a front-edge stop 5.3 (front lay) and a rear-edge stop 5.4 (back lay).

The chain conveyor 4 includes conveyor chains 4.1, gripper bridges 4.2, a drive sprocket 4.3 and a guide sprocket 4.4.

A sheet guiding mechanism 6 is shown in the rising region of the chain delivery 1. The mechanism is hollow. It comprises two inlet sockets 6.1, 6.2 and one outlet socket 6.3 for feeding blast air in and out. The side of the guiding mechanism which faces the sheet 3 is provided with blasting jets, which are not included in the figure.

An important element of the chain delivery is a braking device 7. This will now be described in detail.

Figure 2:
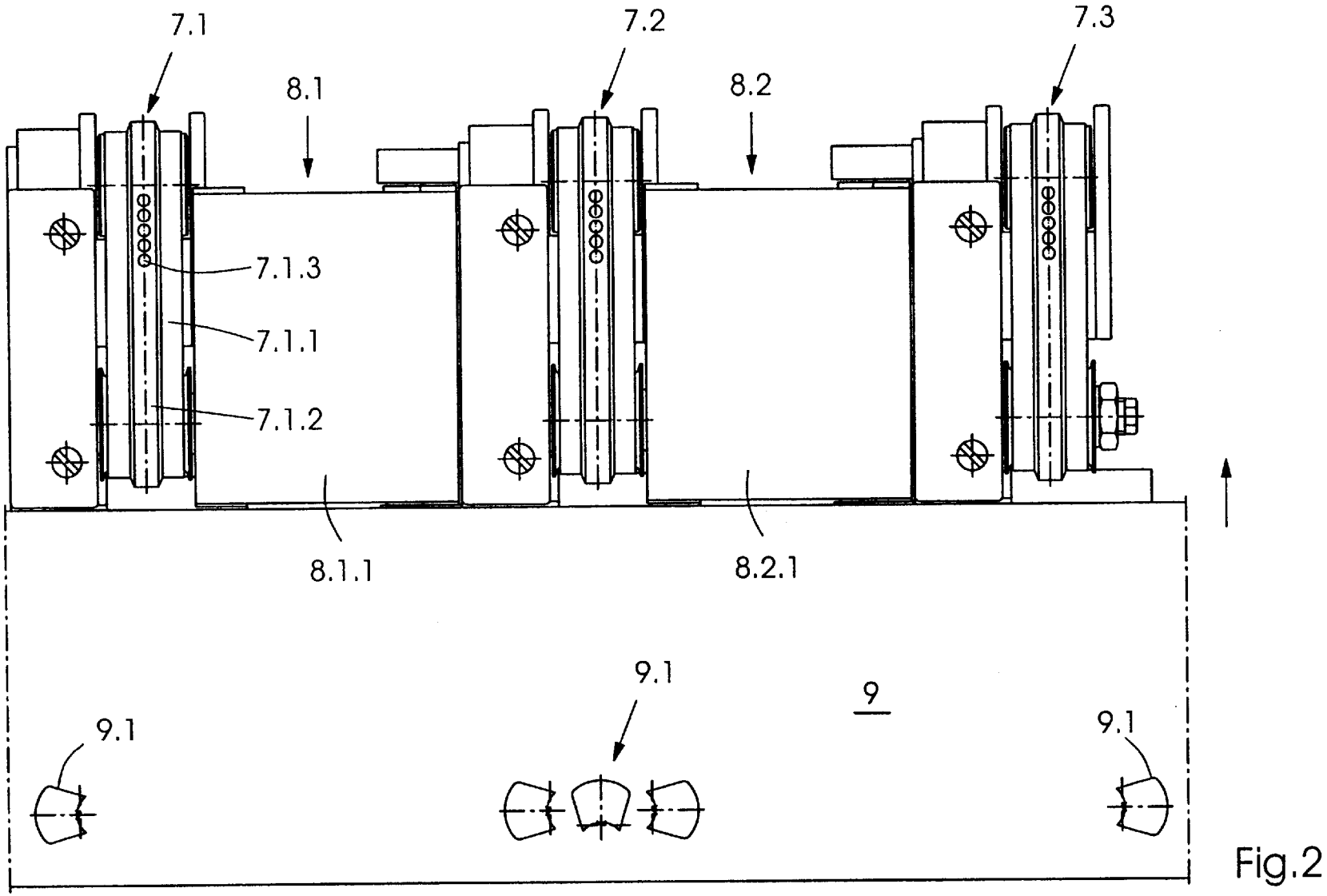
FIG. 2 is a plan view of a part of the sheet delivery represented in FIG. 1.

The plan view represented in FIG. 2 includes three suction tape brake modules 7.1, 7.2 and 7.3. The suction tapes are provided with boreholes 7.1.3, which are connected to low pressure. The brake modules 7.2 and 7.3 are constructed the same way.

The arrow on the right margin in FIG. 2 indicates the direction of sheet transport. The brake modules 7.1 to 7.3 are displaceable transverse hereto, so that the spacing between them is variable.

Sheet guiding mechanisms 8.1, 8.2 are important components of the invention. These will be described in detail below. These notably include respective tapes 8.1.1, 8.2.1. The tapes are non-rollable perpendicular to the direction of sheet transport, just as the brake modules 7.1 to 7.3.

Lastly, a sheet guide plate 9 is illustrated. The plate 9 is connected in series with the brake modules 7.1 to 7.3 and the sheet guiding devices 8.1, 8.2.

Figure 3:
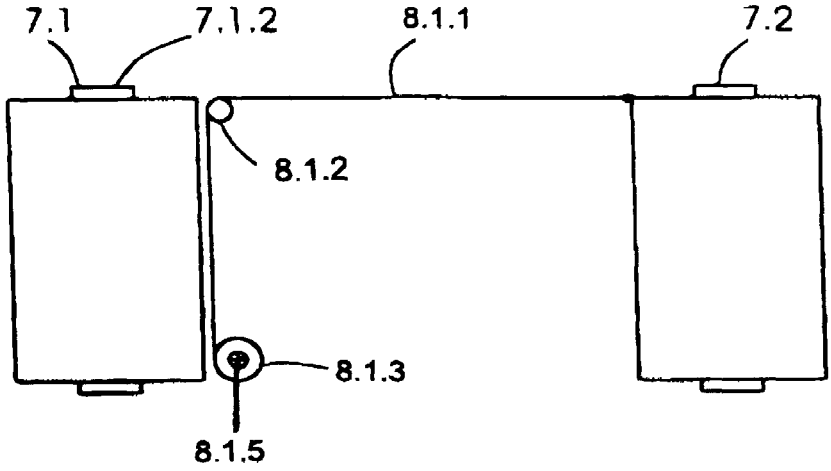
FIG. 3 is a schematic view of a first exemplary embodiment of the invention (variant I), seen in the direction of sheet transport in a vertical projection.
Figure 4:
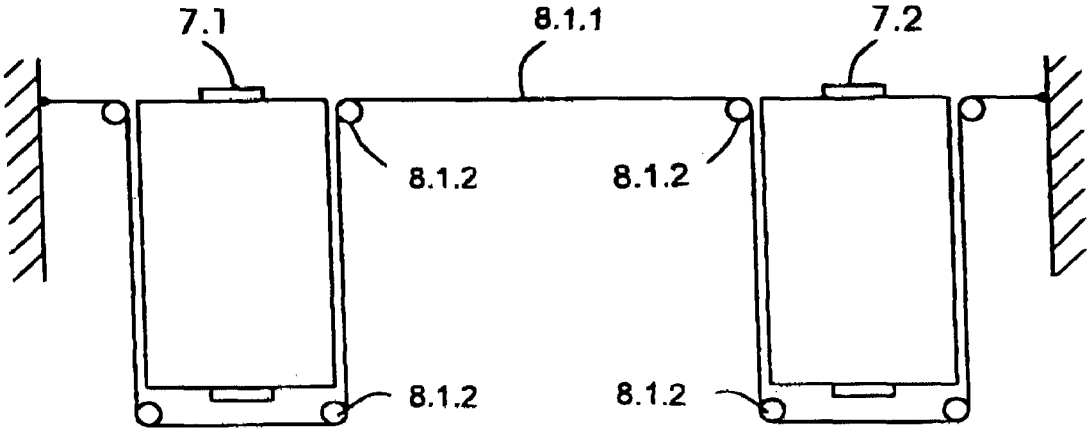
FIG. 4 is a second alternative embodiment (variant II)
Figure 5:
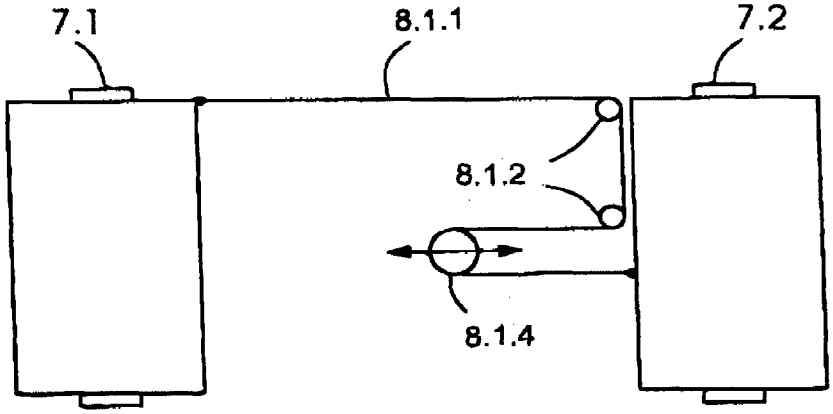
FIG. 5 is a third alternative embodiment (variant III)
Figure 6:
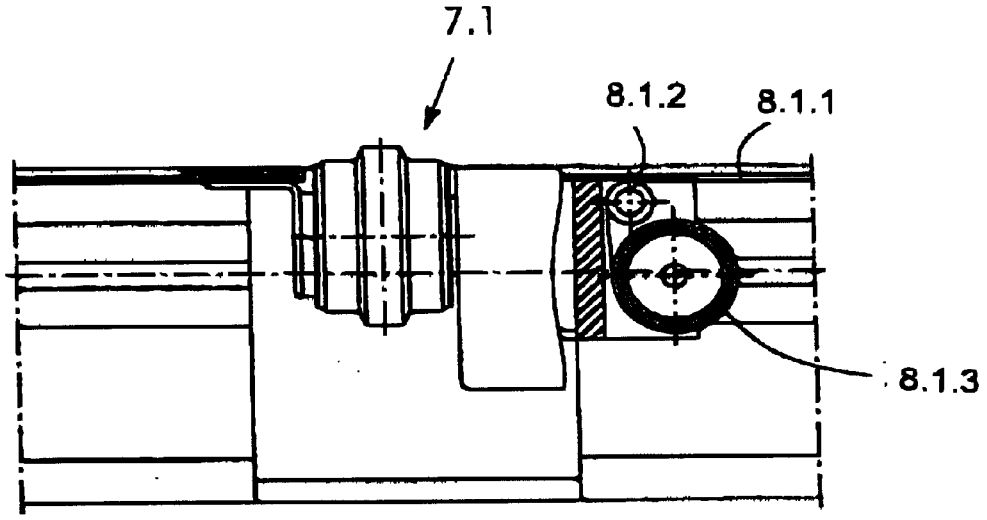
FIG. 6 is a more detailed view of a concrete embodiment of important individual parts of the first embodiment of FIG. 3.
Figure 7:
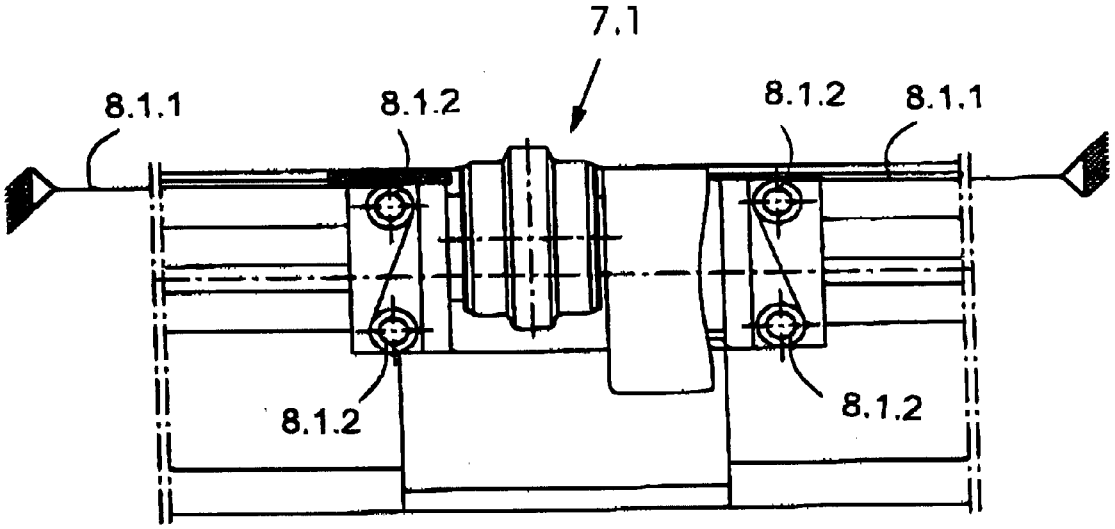
FIG. 7 is a more detailed view of a concrete embodiment of the most important parts of the second embodiment of FIG. 4.

In each of the three variants I to III represented in the FIGS. 3 to 5, two brake modules 7.1, 7.2 are represented in highly schematic views. These are movable such that the spacing between them can be changed from one job to the next.

A sheet guiding mechanism 8.1 is also depicted, whose most important element is a tape 8.1.1. The tape surrounds guide rolls.

In the variant I represented in FIG. 3, one end of the tape (the second end) is fastened to the brake module 7.2. The other end of the tape (the first end) is wrapped around a roller 8.1.3, then around a guide roll 8.1.2. Guide roll 8.1.2 and roller 8.1.3 are mounted at brake module 7.1, which is not included here.

The roller 8.1.3 is a dispensing roller that is provided with a spring mechanism 8.1.5 in the interior of the roller 8.1.3. The spring mechanism 8.1.5 tends to turn the roller 8.1.3 continuously so as to keep the tape 8.1.1 taut at all times. When the two brake modules 7.1, 7.2 are moved apart, the guide roll 8.1.2 and the roller 8.1.3 follow the brake module 7.1. The tape 8.1.1 is thus automatically drawn from the roller 8.1.3. Given an opposite motion, in the sense of reducing the spacing of the brake modules, the roller 8.1.3 takes up length of the tape 8.1.1 again as a result of the spring action.

The spring mechanism 8.1.5 is one example of a winding drive which is disposed to bias the dispensing roller 8.1.3 to continuously keep the tape 8.1.1 taut. The winding drive 8.1.5 may also be a motorized winding drive or a pneumatic winding drive.

In the variant represented in FIG. 4, only a single tape 8.1.1 is provided, not a plurality of tapes. Each end of this tape 8.1.1 is fastened in place, for instance at a lateral frame of the press. The tape is likewise allocated to and mounted at the brake module 7.2. by way of the four guide rolls 8.1.2 pictured on the left of the Figure, whereas the four guide rolls 8.1.2 on the right are allocated to and mounted at the brake module 7.2.

If the positions of the two brake modules 7.1, 7.2 are changed, the guide rolls 8.1.2 follow the brake module to which they are allocated. The length of the tape 8.1.1 between fastening points remains constant. In the variant III represented in FIG. 5, a tape as well as at least one guide roll and one dancer roll 8.1.4 are provided between every two adjacent brake modules 7.1, 7.2. One end of the tape 8.1.1 is fastened to brake module 7.1, and the other end is fastened to brake module 7.2. The guide rolls 8.1.2 are mounted at brake module 7.2 and movable together with it.

Of course, the tape 8.1.1 has a constant length here as well. If the spacing between the brake modules 7.1, 7.2 changes, the dancer roll 8.1.4 executes a corresponding motion. It thus accounts for said spacing modification by lengthening or shortening the memory loop.

As can be seen in FIGS. 3 to 5, in the working region the tape 8.1.1 is on substantially the same level as the top edges of the brake module.

In all three cases, the individual sheet, which is not included in the figure, runs on the suction tapes, which are only schematically represented (see suction tape 7.1.2 in FIG. 3). Between the tape 8.1.1 of the sheet guiding mechanism and the sheet, there is an air cushion which guarantees contactless bearing of the sheet.

The constructional embodiment of variant I represented in rig. 6 includes a brake module 7.1, a guide roll 8.1.2 and a roller 8.1.3.

The constructional embodiment of variant II includes a single tape 8.1.1. This is fastened to a frame at each end.

This also includes a brake module 7.1. Four guide rolls 8.1.2 are mounted on this and structurally united with it. If the brake module 7.1 moves in one or the other direction, the guide rolls 8.1.2 move with it, thus traveling along the tape 8.1.1.

Figure 8:
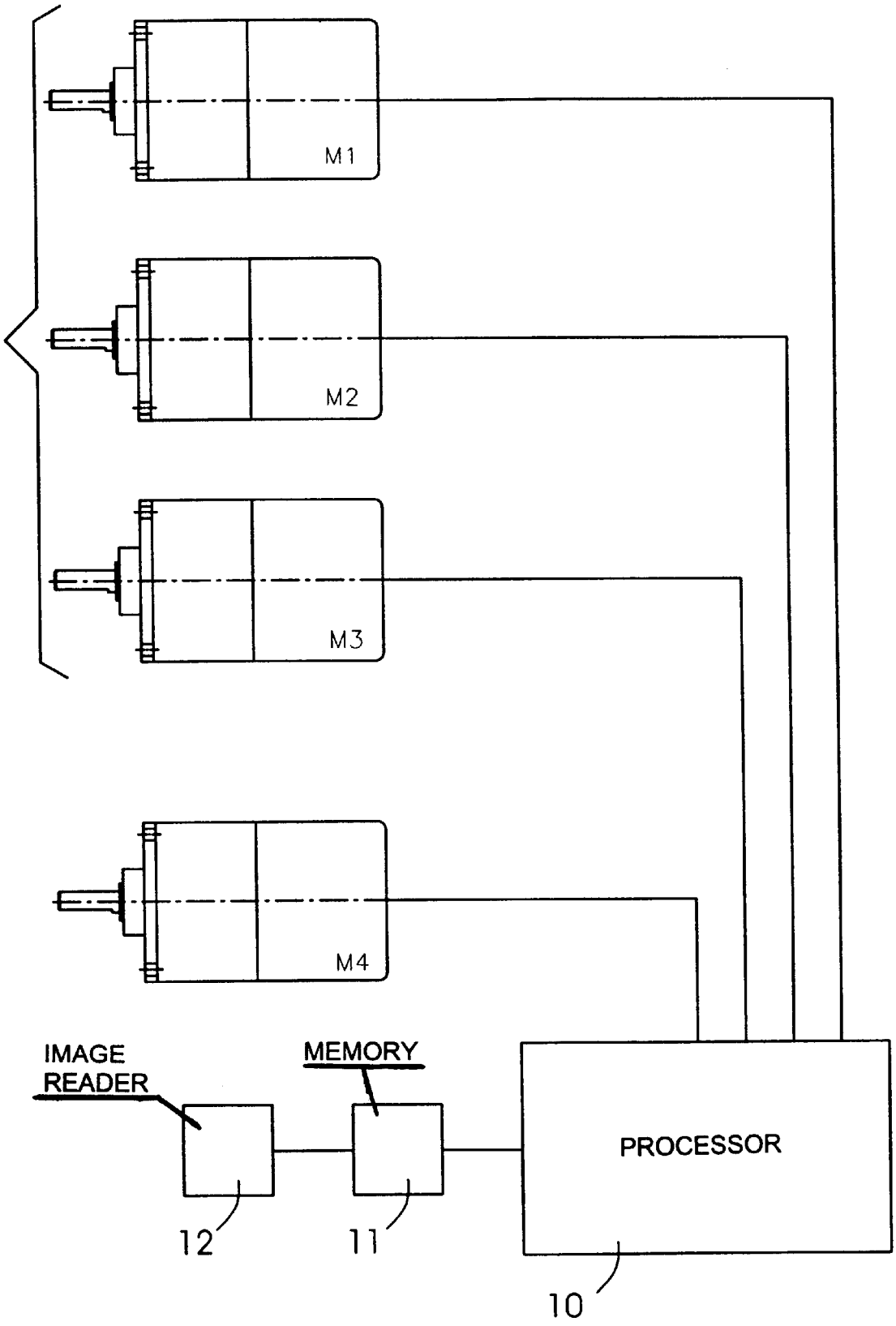
FIG. 8 is a block circuit diagram representing the remote adjustment of brake modules.

The block circuit diagram represented in FIG. 8 contains four motors M1 to M4. The motors M1 to M3 serve for positioning the individual brake modules relative to the subject, whereas motor M4 provides for the adjustment of the sheet brake on the print format. The circuit comprises a computer 10 or processor 10, a data memory 11 and an image reader 12.

Figure 9:
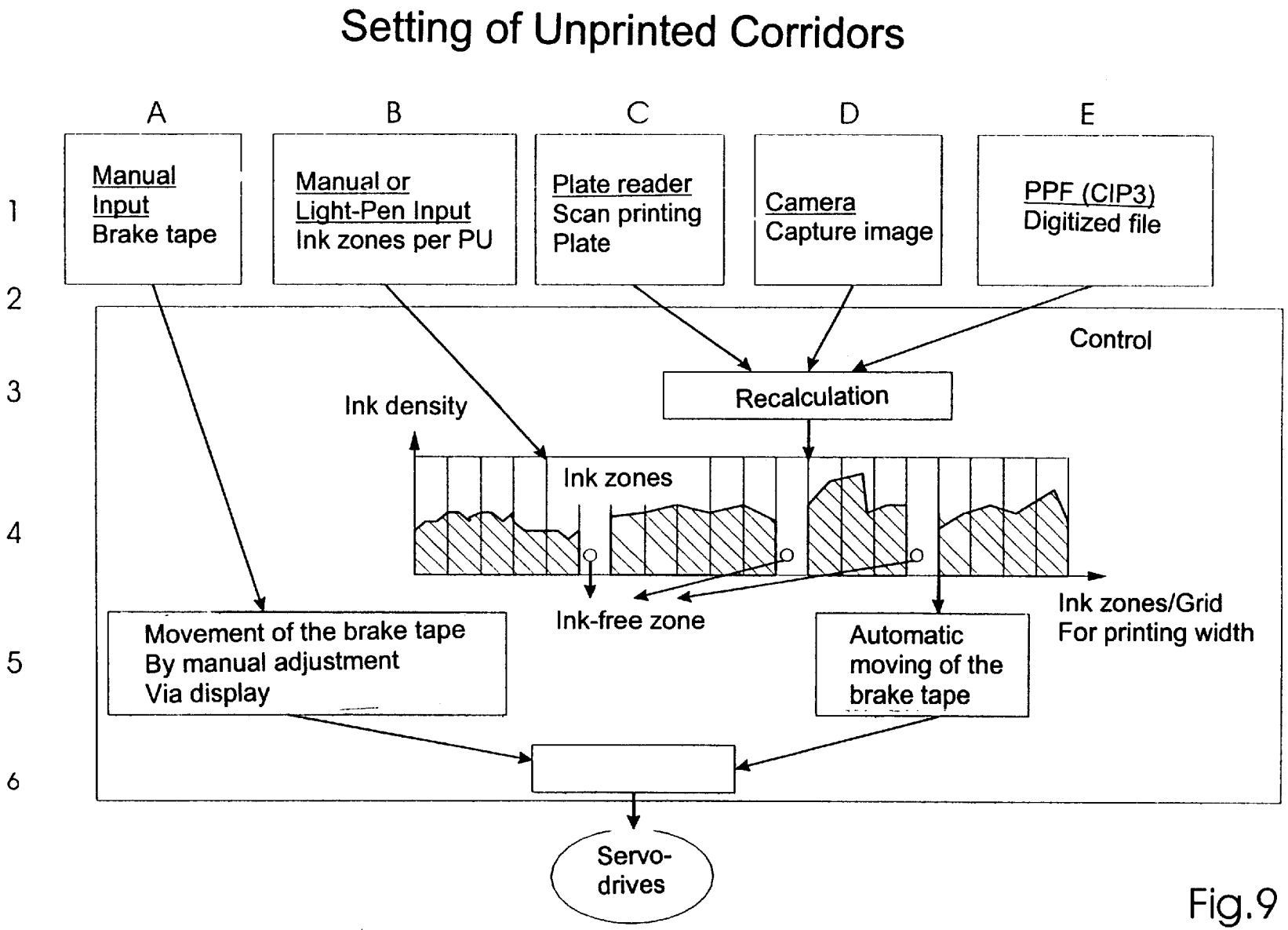
FIG. 9 a second block circuit diagram, representing the setting of the unprinted corridors.

FIG. 9 is a schematic representation of the adjusting of the unprinted corridors.

The following table contains a more precise classification of the steps represented in FIG. 9.

| Manual Input | Manual or Light-Pen Input | Plate reader | Camera | PPF (CIP3) |
|---|---|---|---|---|
| Brake tape | Ink zones per PU | Scan printing plate | Capture image | Digitized file |
| Visual evaluation of the image by the printer | Visual evaluation of the image by the printer | Scanning of the printing plates line by line (perpendicular to the printing direction) | Capturing of the image information by means of the camera | Outputting of the image information from the preliminary printing stage |
| Direct actuation of the servo-drive by means of keys and display for user guidance | Input by means of ink zone keys or light pen | Input online or data carriers | Input online or data carriers | Input online or data transfer |
| 1:1 | 1:1 | Recalculation/ Determination of the ink distribution on the sheet | Recalculation/ Determination of the ink distribution on the sheet | Recalculation/ Determination of the ink distribution on the sheet |
| 1:1 | Determination of the zones which are uninked or minimally inked (doctor blade threshold) over all printing units. The positions of the brake tapes can be calculated from these. If there are fewer uninked zones than brake tapes, the outer ones must be moved into parked position. | | | |
| Movement within the adjustment limits according to manual input | Algorithm which distributes optimally evenly over the print widths computes the positions of the brake tapes. | | | |
| Actuation of the servo-motor as long as the manual adjustment is active | Automatic moving of the brake tape | Automatic moving of the brake tape | Automatic moving of the brake tape | Automatic moving of the brake tape |

We claim:

1. A delivery for a sheet processing machine wherein sheets are delivered in a sheet transport direction, comprising:

a plurality of braking devices displaceably disposed transverse to the sheet transport direction and forming interspaces therebetween with a variable spacing;

sheet guiding elements respectively covering said interspaces between two adjacent braking mechanisms, said sheet guiding elements including a tape of flexible material having a first end and a second end;

a dispensing roller with a longitudinal axis parallel to said sheet transport direction allocated to one of said two adjacent braking devices;

said first end of said tape surrounding said dispensing roller and said second end of said tape being fastened to the other of said two braking devices; and a winding drive allocated to said dispensing roller.

2. The delivery according to claim 1, wherein said winding drive is a spring disposed to bias said dispensing roller to continuously keep said tape taut.

3. The delivery according to claim 1, wherein said winding drive is a motorized winding drive.

4. The delivery according to claim 1, wherein said winding drive is a pneumatic winding drive.

5. The delivery according to claim 1, wherein said sheet guiding elements comprise:

a single tape for all said braking devices;

said single tape having two ends respectively fastened to lateral frames of the delivery;

said tape surrounding the individual said braking devices and wrapping around said braking device underneath.

6. The delivery according to claim 1, wherein:

a respective tape is provided between two respective adjacent braking devices of said plurality of braking devices;

each end of said tape is fastened to one of said two braking devices; and a dancer roller is disposed to compensate a length change of said tape given changes in the spacing between said two brake devices, said dancer roller carrying a memory loop of said tape.

7. The delivery according to claim 1 in combination with a printing machine, which comprises:

a data memory for storing data related to an image to be processed in the printing machine;

a computer for generating control signals correlated with unprinted corridors of the image; and said plurality of braking devices being configured to be adjustable by actuating drives controlled by the control signals generated by said computer, into positions correlated with the unprinted corridors.

8. The delivery according to claim 7, which comprises an image reader configured to set and read into said data memory the data correlated with the image.

9. The delivery according to claim 8, wherein said image reader is a CCD camera.

10. The delivery according to claim 8 in combination with a printing unit transferring the image via a printing forme.

11. The delivery according to claim 10, wherein the print forme is an offset plate, and said image reader is a plate reader.

* * * * *